US009981153B2

(12) United States Patent
Chou

(10) Patent No.: US 9,981,153 B2
(45) Date of Patent: May 29, 2018

(54) BRAKE CONTROLLER FOR SPINNER BIKE

(71) Applicant: CHI HUA FITNESS CO., LTD., Hsinchu County (TW)

(72) Inventor: Chia-Cheng Chou, Hsinchu County (TW)

(73) Assignee: CHI HUA FITNESS CO., LTD., Hsinchu County (TW)

( * ) Notice: Subject to any disclaimer, the term of this patent is extended or adjusted under 35 U.S.C. 154(b) by 228 days.

(21) Appl. No.: 15/136,083

(22) Filed: Apr. 22, 2016

(65) Prior Publication Data

US 2017/0304667 A1 Oct. 26, 2017

(51) Int. Cl.

| | |
|---|---|
| ***A63B 24/00*** | (2006.01) |
| ***A63B 21/005*** | (2006.01) |
| ***A63B 22/06*** | (2006.01) |

(52) U.S. Cl.

CPC ..... *A63B 21/0056* (2013.01); *A63B 22/06* (2013.01); *A63B 24/0087* (2013.01)

(58) Field of Classification Search

CPC ..... A63B 21/0056; A63B 21/00192; A63B 21/225; A63B 22/06; A63B 22/0605; A63B 24/0087

See application file for complete search history.

(56) References Cited

U.S. PATENT DOCUMENTS

| | | | | |
|---|---|---|---|---|
| 4,475,408 A * | 10/1984 | Browning | ..... | A63B 21/0056 73/379.06 |
| 9,839,810 B1 * | 12/2017 | Tzeng | ..... | A63B 24/0087 |
| 2017/0036053 A1 * | 2/2017 | Smith | ..... | A63B 21/0125 |

* cited by examiner

*Primary Examiner* — Vishal R Sahni
(74) *Attorney, Agent, or Firm* — Rosenberg Klein & Lee

(57) ABSTRACT

A brake controller for spinner bikes has a frame body engaging a pair of connecting pieces, a shaft engaging a first block through a top end thereof and a second block through a bottom end thereof, and a magnetic encoder that has a PCB with coding circuit for detecting rotation of a magnet disposed under the second block. Thereby the brake controller controls two kinds of braking forces by a single button for spinner bikes.

10 Claims, 6 Drawing Sheets

BRAKE CONTROLLER FOR SPINNER BIKE

BACKGROUND OF THE INVENTION

1. Field of the Invention

The invention relates to a brake controller for spinner bikes, particularly to one that controls braking force by pressing a button thereof for braking and that controls magnetic resistance by rotating the button for braking.

2. Description of the Related Art

Spinner bikes usually have braking devices. In FIG. 1, a spinner bike 10 has a braking element 12 for a flywheel 11 to produce a braking force. The braking element 12 engages an end of a connector 13 which has the other end connected to an end of a cable 14. The cable 14 has the other end connected to a brake controller 15. A braking force is produced when the brake controller 15 pulls the cable 14 to rotate the connector 13 and force the braking element 12 to contact with the flywheel 11 for friction. However, such braking device cannot stand the intense and constant frictions and the components are rapidly consumed due to wear and tear. Also, a strong smell is produced in the braking operation due to the friction contact.

SUMMARY OF THE INVENTION

A primary object of the present invention is to provide a brake controller for spinner bikes that has one single controller for two different braking forces control.

Another object of the present invention is to provide a brake controller for spinner bikes that can reduce the wear and tear of braking devices and the smell from friction operation.

To achieve the objects above, the present invention comprises a frame body formed by a first board, a second board, and a plurality of support rods engaged between the first and second boards, said first and second boards each having a spindle hole, a positioning hole, and a first fillister space correspondingly arranged; a pair of connecting pieces, each having a pivot hole, an engaging hole, and a second fillister space, said connecting pieces being connected by a connecting rod and engaging a pivot rod by the pivot holes to further engage the spindle holes of the frame body to be fixed thereto; a first block having a first through hole and two first fixing sections that arranged correspondingly aside for engagement with the positioning holes of the frame body; a shaft with an annular protrusion to engage through the first through hole of the first block and place the first block on the annular protrusion, said shaft then engaging a spring element on the first block and then a button on the spring element at a top end thereof; a second block with a second through hole to be engaged through at a bottom end of the shaft to be placed under the annular protrusion and two second fixing sections each arranged aside for engagement with the first fillister spaces of the connecting pieces; and a magnetic encoder including a magnet disposed under the bottom end of the shaft and a PCB with coding circuit disposed under the second block for inspecting rotation angle of the magnet.

Furthermore, the second board has a positioning piece with a third through hole; a pivot tube engages the pivot holes of the connecting pieces and is fixed by a pair of rings correspondingly engaging at outer sides of the connecting pieces. The pivot rod fixes the connecting pieces to the spindle holes of the frame body by having a pair of first fixing elements fixed at both sides thereof; the connecting rod engages the engaging holes of the connecting pieces and has both ends fixed by a pair of second fixing elements; and the second block is fixed to the connecting pieces by having a pair of third fixing elements fixing the second fixing sections thereof.

In addition, the support rod is fixed to the first and second boards by a plurality of screws screwing screw holes at both ends thereof. The shaft has a threaded section at the top end thereof for engaging the button and being fixed by a nut, and the button further has a cap thereon; the shaft also has a threaded section at the bottom end thereof for engaging through the second block and being fixed by a nut. The PCB is disposed under the second block and fixed by a plurality of screws. The magnet is covered by a nut cover to be fixedly disposed between the shaft and the PCB by a nut cap. In an embodiment, the spring element is a spring.

Based on the structures disclosed above, the present invention has the button for controlling two different braking forces: braking resistance by pressing and magnetic resistance by rotating. Also, it can lessen the wear and tear of the device and reduce the smell from friction operation.

DETAILED DESCRIPTION OF THE PREFERRED EMBODIMENT

Figure 1:
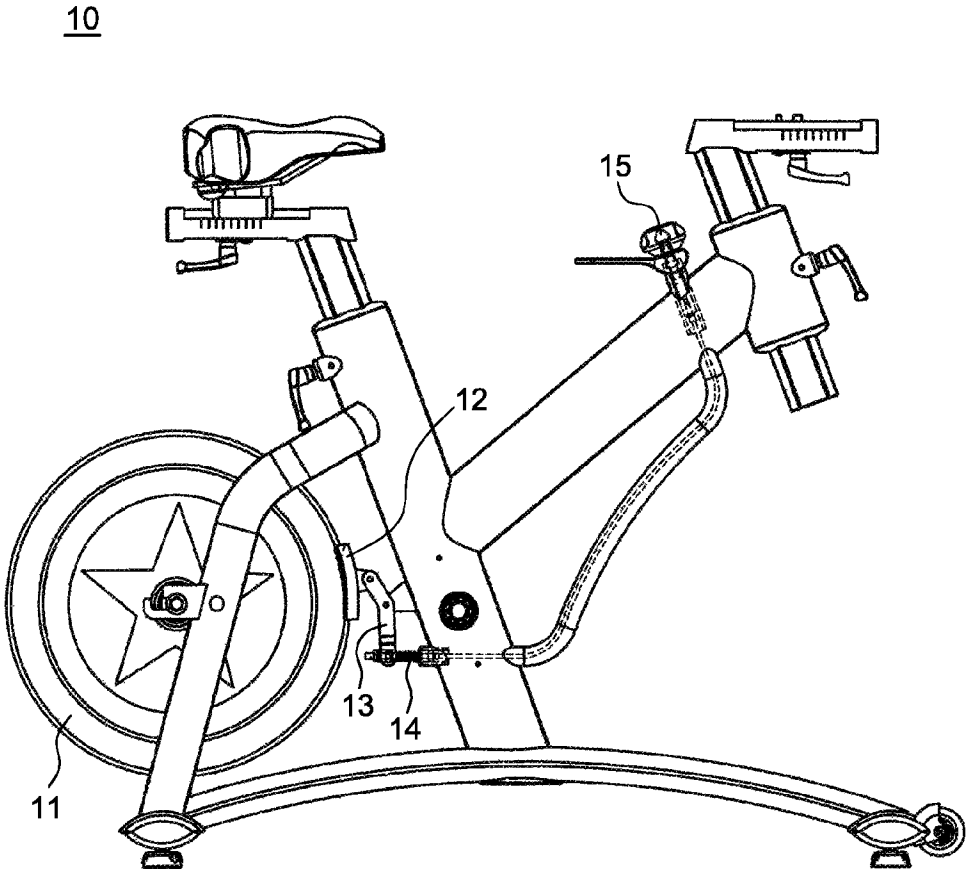
FIG.1 PRIOR ART
FIG. 1 is a schematic diagram of a conventional braking device on a spinner bike.
Figure 2:
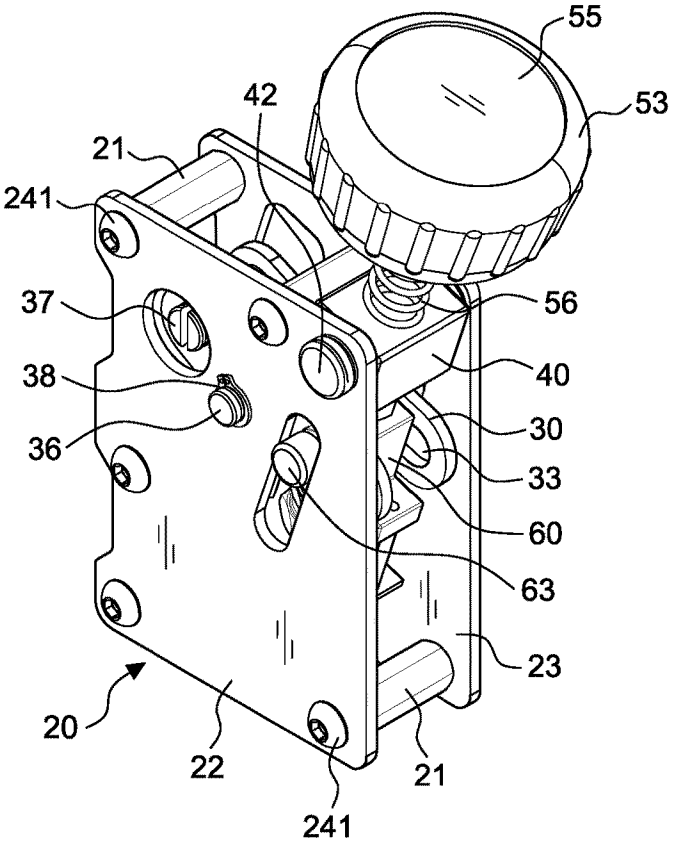
FIG. 2 is a perspective view of the present invention.
Figure 3:
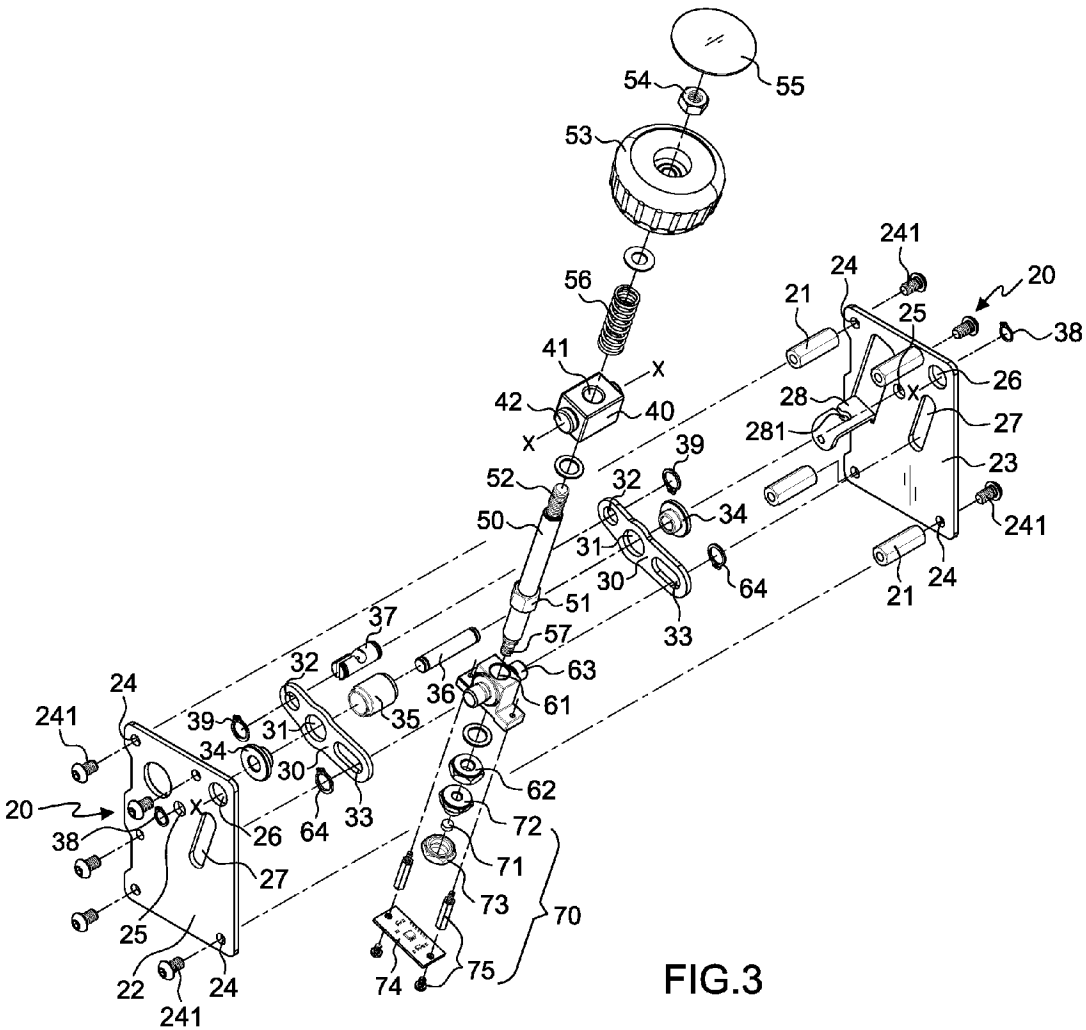
FIG. 3 is an exploded view of structure of the present invention.

Referring to FIGS. 2-5, the present invention comprises a frame body 20, a pair of connecting pieces 30, a first block 40, a shaft 50, a second block 60, and a magnetic encoder 70.

The frame body 20 is formed by a first board 22, a second board 23, and a plurality of support rods 21 engaged between the first and second boards 22, 23 by a plurality of screws 241 screwing through a plurality of screw holes 211 at both ends of the support rods 21. The first and second boards 22, 23 each has a spindle hole 25, a positioning hole 26, and a first fillister space 27 correspondingly arranged. The second board 23 further has a positioning piece 28 with a third through hole 281.

Each of the connecting pieces 30 has a pivot hole 31, an engaging hole 32, and a second fillister space 33. Each pivot holes 31 has a ring 34 engaging therewith to fix a pivot tube 35 in-between. The connecting pieces 30 are further connected by a connecting rod 37 and engaging a pivot rod 36 by the pivot holes 31 to further engage the spindle holes 25 of the frame body 20 to be fixed thereto. The pivot rod 36 is disposed through the pivot tube 35 and has a pair of first fixing elements 38 fixed at both ends thereof to connect the connecting pieces 30 through the pivot holes 31 and to form the frame body 20 by fixing the spindle holes 25 as well. The connecting rod 37 also has a pair of second fixing elements 39 fixed at both ends thereof to connect the connecting pieces 30 through the engaging holes 32.

The first block 40 has a first through hole 41 and two first fixing sections 42 that arranged correspondingly aside thereof for engagement with the positioning holes 26 of the frame body 20.

The shaft 50 has an annular protrusion 51 to engage through the first through hole 41 of the first block 40 and place the first block 40 on the annular protrusion 51. The shaft 50 then engages a spring element 56 on the first block 40 and then a button 53 on the spring element 56 at a top end thereof; the top end has a threaded section 52 to be screwed by a nut 54 and then to be covered by a cap 55 thereon.

The second block 60 has a second through hole 61 to be engaged through at a bottom end of the shaft 50 to be placed under the annular protrusion 51 and two second fixing sections 63 arranged correspondingly aside thereof for engagement with the first fillister spaces 27 of the connecting pieces 30. The bottom end of the shaft 50 further has a threaded section 57 for a nut 62 to screw tight and the second fixing sections 63 engage a pair of third fixing elements 64 to fix the second block 60 to the connecting pieces 30.

The magnetic encoder 70 includes a magnet 71 disposed under the bottom end of the shaft 50 and a PCB 74 with coding circuit disposed under the second block 60 for inspecting rotation angle of the magnet 71. In this embodiment, the PCB 73 is disposed under the second block 60 and is fixed by a plurality of screws 75, and the magnet 71 is covered by a nut cover 72 to be fixedly disposed between the shaft 50 and the PCB 74 by a nut cap 73.

Figure 6:
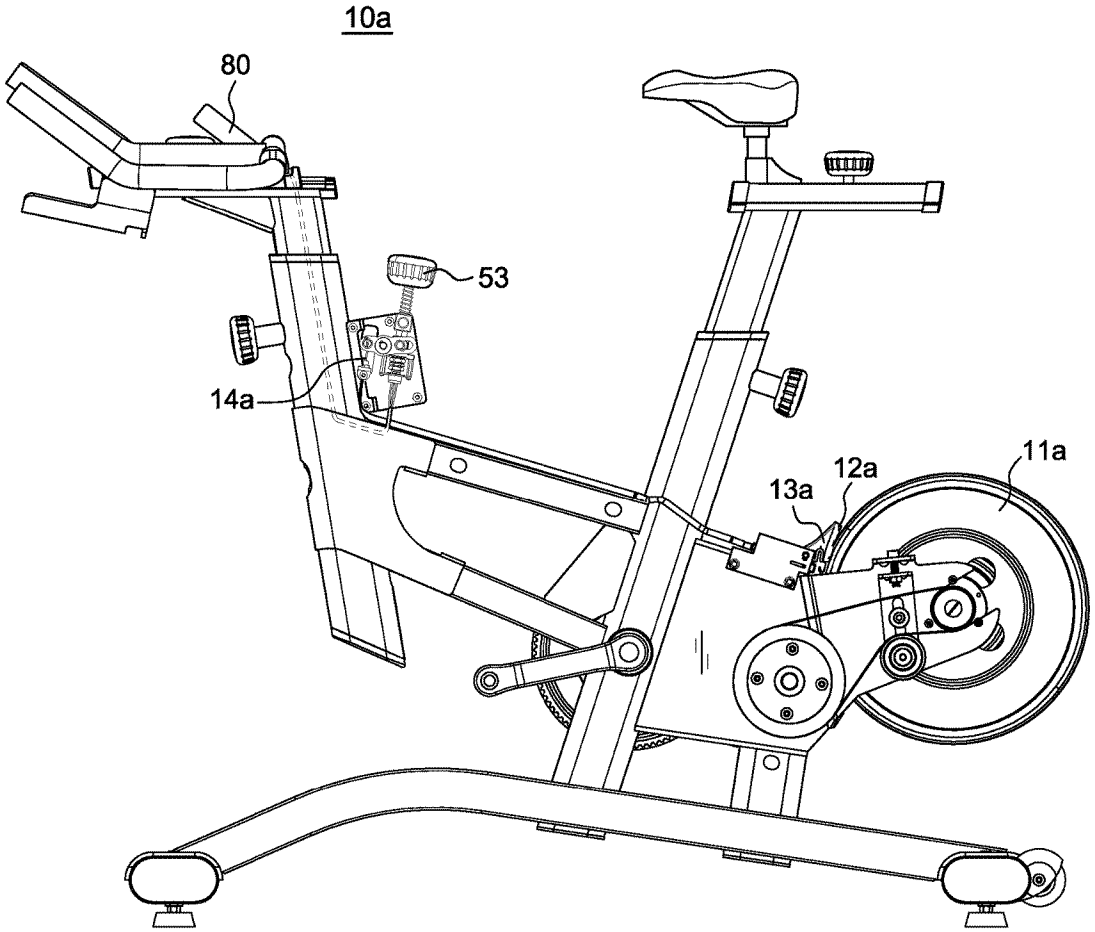
FIG. 6 is a practical application view of the present invention installed on a spinner bike.

With reference to FIG. 6, the present invention can be applied to a brake device 12*a* installed on spinner bike 10*a* for braking a flywheel 11*a*. The brake device 12*a* engages an end of a connector 13*a* and a cable 14*a* is connected to the other end of the connector 13*a;* the cable 14*a* then pass through the third through hole 281 to fixedly tied up with the connecting rod 37.

Figure 4:
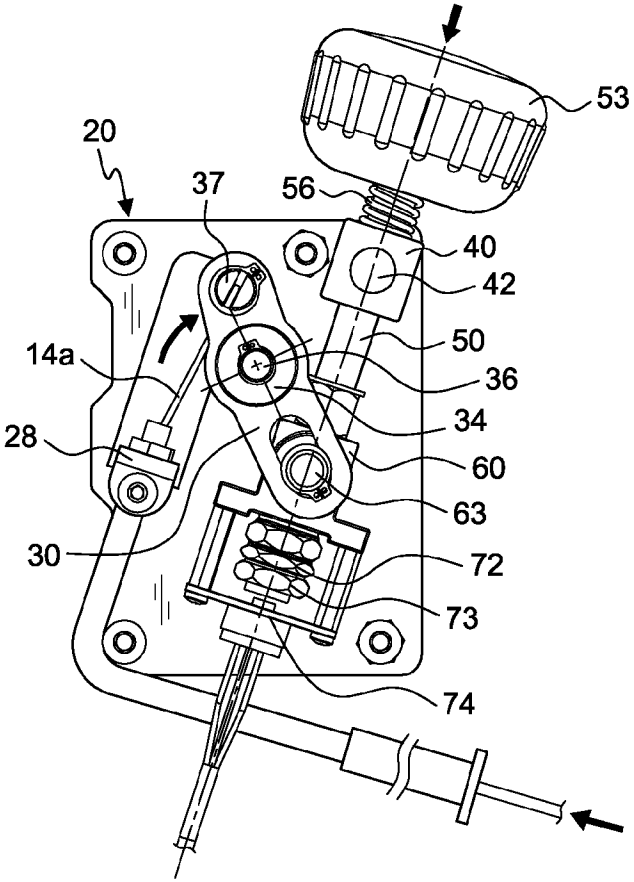
FIG. 4 is a schematic diagram of the present invention illustrating pressing of a button thereof for braking.

Further referring to FIG. 4, upon pressing the button 53, the shaft 50 displaces downwards together with the second block 60 with the second fixing sections 63 displacing within the first fillister spaces 27 on the first and second boards 22, 23. The second block 60 then displaces the connecting pieces 30 downwards by having the second fixing sections 63 displacing within the second fillister spaces 33, raising up the other end of the connecting pieces 30 with the engaging holes 32 and pulling the cable 14*a* by the connecting rod 37 to drive the connector 13*a* for braking operation. Then the button 53 can return back to its position by the spring element 56.

Figure 5:
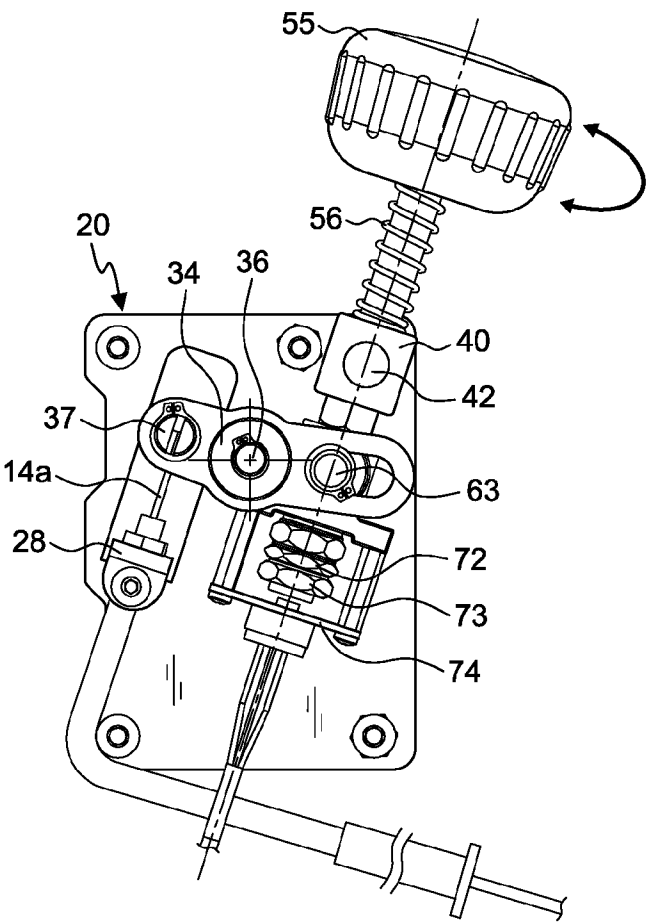
FIG. 5 is a schematic diagram of the present invention illustrating rotating of the button thereof for braking.
Figure 7:
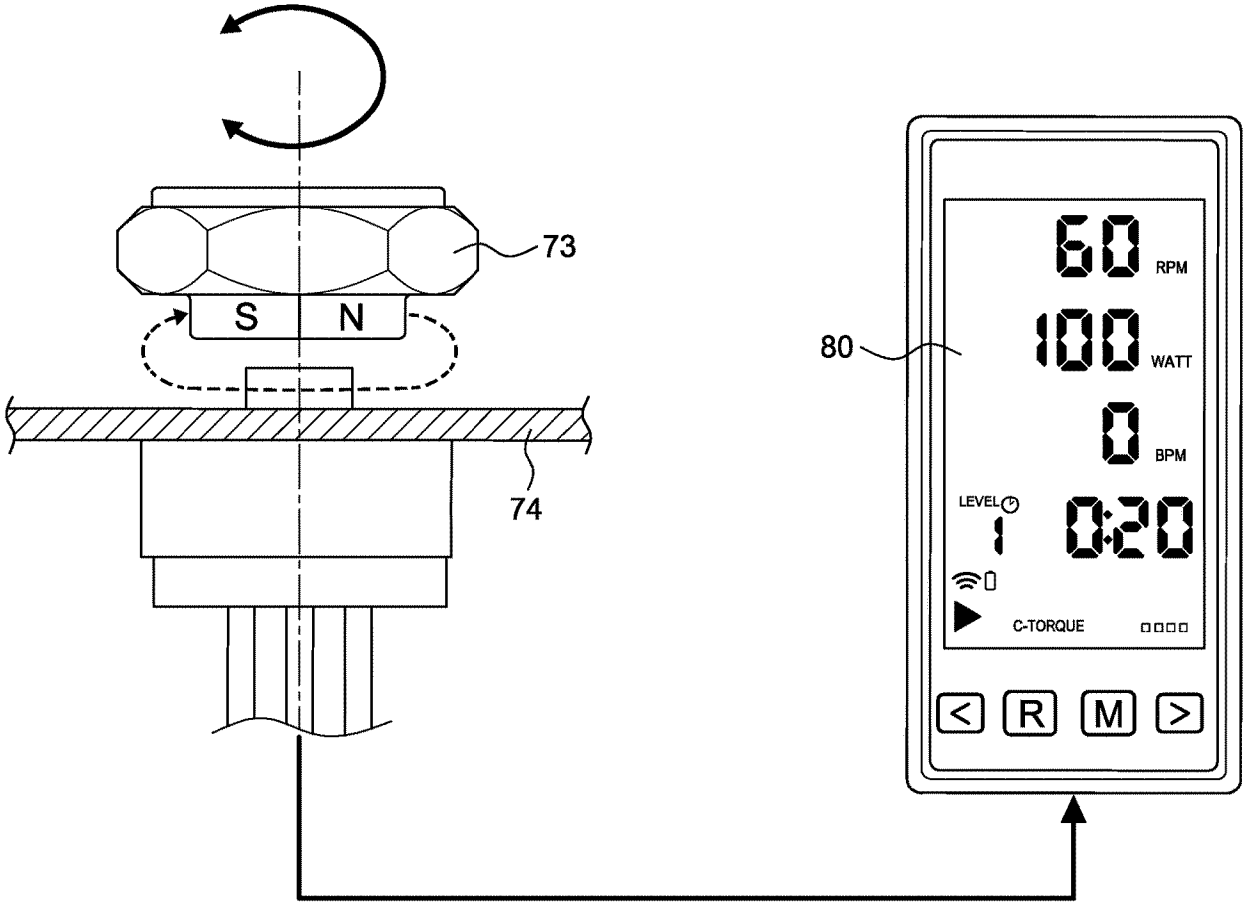
FIG. 7 is a schematic diagram illustrating the present invention detecting rotation of a magnet thereof for operation.

On the other hand, referring to FIG. 5, upon rotating the button 53, the magnet 71 under the shaft 50 would be rotated thereby while the PCB 74 and the second block 60 under which would not due to the second fixing sections 63. The PCB 74 then detect the rotation angle of the magnet 71 by the coding circuit and display the data as shown in FIG. 7. The data is transmitted to an interface 80 and then to a magnetic resistance device (not shown) to produce magnetic resistance for the flywheel 11*a*.

Based on the structures disclosed, the present invention has the button 53 to control the braking forces by pressing and rotating. In addition, it produces two different braking forces with one single button 53, reducing the wear and tear of a braking device and also the smell resulted from constant and intense frictions.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A brake controller for spinner bikes comprising:

a frame body formed by a first board, a second board, and a plurality of support rods engaged between the first and second boards, said first and second boards each having a spindle hole, a positioning hole, and a first fillister space correspondingly arranged;

a pair of connecting pieces, each having a pivot hole, an engaging hole, and a second fillister space, said connecting pieces being connected by a connecting rod and engaging a pivot rod by the pivot holes to further engage the spindle holes of the frame body to be fixed thereto;

a first block having a first through hole and two first fixing sections that arranged correspondingly aside for engagement with the positioning holes of the frame body;

a shaft with an annular protrusion to engage through the first through hole of the first block and place the first block on the annular protrusion, said shaft then engaging a spring element on the first block and then a button on the spring element at a top end thereof;

a second block with a second through hole to be engaged through at a bottom end of the shaft to be placed under the annular protrusion and two second fixing sections each arranged aside for engagement with the first fillister spaces of the connecting pieces; and a magnetic encoder including a magnet disposed under the bottom end of the shaft and a PCB with coding circuit disposed under the second block for inspecting rotation angle of the magnet.

2. The brake controller for spinner bikes as claimed in claim 1, wherein the second board further has a positioning piece with a third through hole.

3. The brake controller for spinner bikes as claimed in claim 1, wherein a pivot tube further engages the pivot holes of the connecting pieces and is fixed by a pair of rings correspondingly engaging at outer sides of the connecting pieces.

4. The brake controller for spinner bikes as claimed in claim 1, wherein the pivot rod fixes the connecting pieces to the spindle holes of the frame body by having a pair of first fixing elements fixed at both ends thereof; the connecting rod engages the engaging holes of the connecting pieces and has both ends fixed by a pair of second fixing elements; and the second block is fixed to the connecting pieces by having a pair of third fixing elements fixing the second fixing sections thereof.

5. The brake controller for spinner bikes as claimed in claim 1, wherein the support rod is fixed to the first and second boards by a plurality of screws screwing screw holes at both ends thereof.

6. The brake controller for spinner bikes as claimed in claim 1, wherein the spring element is a spring.

7. The brake controller for spinner bikes as claimed in claim 1, wherein the shaft has a threaded section at the top end thereof for engaging the button and being fixed by a nut, and the button further has a cap thereon.

8. The brake controller for spinner bikes as claimed in claim 1, wherein the PCB is disposed under the second block and fixed by a plurality of screws.

9. The brake controller for spinner bikes as claimed in claim 1, wherein the shaft has a threaded section at the bottom end thereof for engaging through the second block and being fixed by a nut.

10. The brake controller for spinner bikes as claimed in claim 9, wherein the magnet is covered by a nut cover to be fixedly disposed between the shaft and the PCB by a nut cap.

* * * * *